United States Patent [19]

Petri

[11] 4,333,420

[45] Jun. 8, 1982

[54] GLUE APPLICATOR

[76] Inventor: Nello J. Petri, 1450 Bancroft Ave., San Francisco, Calif. 94124

[21] Appl. No.: 170,540

[22] Filed: Jul. 21, 1980

[51] Int. Cl.[3] ..... B05C 5/02

[52] U.S. Cl. ..... 118/411; 118/419

[58] Field of Search ..... 118/410, 411, 419, 315

[56] References Cited

U.S. PATENT DOCUMENTS 2,757,636 8/1956 Stephens et al. ..... 118/411 X
2,877,763 3/1959 Paulsen ..... 118/410 X
2,914,108 11/1959 Coakley ..... 118/411
2,988,120 6/1961 Forrest ..... 118/410 X

FOREIGN PATENT DOCUMENTS 1037251 8/1958 Fed. Rep. of Germany ..... 118/411

*Primary Examiner*—John P. McIntosh

[57] ABSTRACT

A glue applicator for applying glue to a moving web is in the form of a gear pump having its housing in close proximity to the web and having a discharge nozzle adapted to discharge glue directly onto the web. The drive and the mount for the housing permit adjustable movement transversely of and normal to the web.

6 Claims, 5 Drawing Figures

GLUE APPLICATOR

This invention relates to a glue applicator of the type which discharge glue in a relatively thin ribbon onto a moving web of paper or the like which is employed with one or more additional similar webs to collate a plurality of webs into a unitary package such as a business form.

In the manufacture of most business forms a plurality of sheets of paper are superposed with a carbon between each pair of adjacent sheets so as to provide a plurality of copies of the particular form. The general practice is to glue adjacent sheets along their margins so that they are adhered together when superposed. This gluing operation is most conveniently carried out by applying a thin ribbon of glue to the continuous paper web as the same is moving toward the point at which it is collated with similar webs and the assembly later cut transversely into stackable units.

Heretofore the common practice has been to provide a central pumping device which pumps the glue from a reservoir under pressure to a discharge manifold from which the glue is conducted through a plurality of flexible tubes to discharge nozzles which in turn are mounted so as to discharge the glue onto each of the moving webs. Since a discharge nozzle is provided along each of the longitudinally extending margins of each web, and since in most cases numerous webs are to be collated it will be understood that numerous discharge nozzles and tubes are required by this system.

When it is desired to stop the moving webs and the flow of glue thereto, a serious problem is encountered because of the inertia of the glue under pressure, and the tendency of the glue to continue to discharge after the web has been stopped usually requires that receptacles be provided under the discharge nozzles to catch the excess and wasted glue.

The main object of the present invention is the provision of a glue applicator that overcomes the disadvantages inherent in glue applicators of the type presently employed.

Another object of the invention is the provision of a glue applicator that is inexpensive to manufacture, extremely flexible to use and capable of accurate control.

Other objects and advantages will be apparent from the following specification and drawings.

Figure 1:
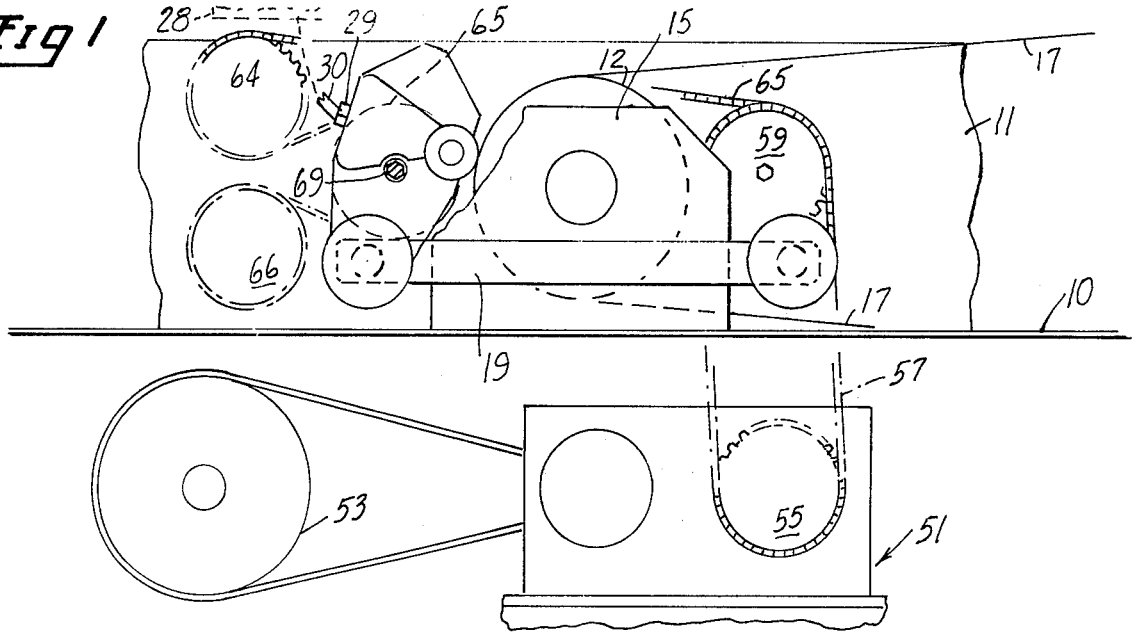
FIG. 1 is a side elevation of a portion of a collator showing the invention in use in combination with one feed roll of the collator.

With reference to FIG. 1 a portion of the collator base plate on which the collated webs are assembled is indicated at 10. Extending upwardly from base 10 is a rear plate 11 in which one end of a feed roller 12 is rotatably supported in bearings, one of which is indicated at 13. The opposite, or front, end of feed roller 12 is rotatably supported in a vertically extending plate 15 extending upwardly from base plate 10.

Figure 2:
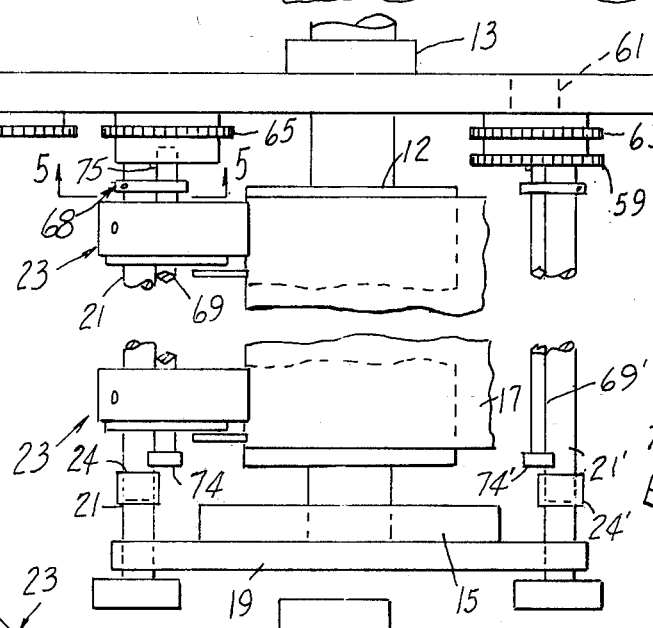
FIG. 2 is a fragmentary top plan view of the structure of FIG. 1 with the drive chain omitted for clarity and with the feed roll broken in length to save space.

In the particular case used as an example in FIG. 1, a web 17, which is unwound from a roll (not shown), is reeved around the left hand side of feed roller 12 and then to the right to overlie a web that has already been received on base 10 from a station to the left of the one shown in FIG. 1. It is to be understood that only one of a plurality of web gluing stations is shown in FIGS. 1, 2 and for a more detailed disclosure of the type of complete arrangement contemplated by the present disclosure reference is made to U.S. Pat. No. 3,794,232.

Extending horizontally between rear plate 11 and a horizontally extending flat bar 19 secured to front plate 15 is a rod 21 of circular cross section which is adapted to support one or more gear pumps generally designated 23.

Figure 3:
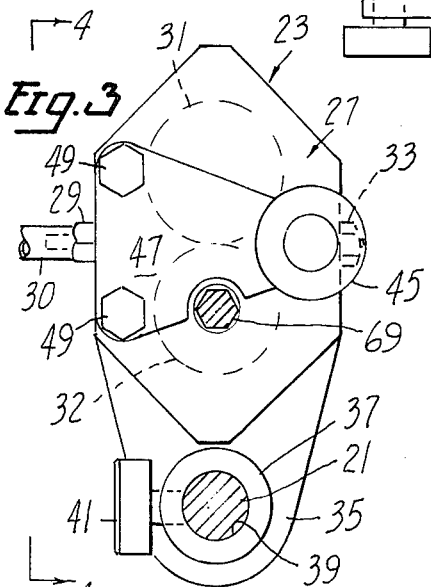
FIG. 3 is an enlarged side elevation of one of the glue applicators.
Figure 4:
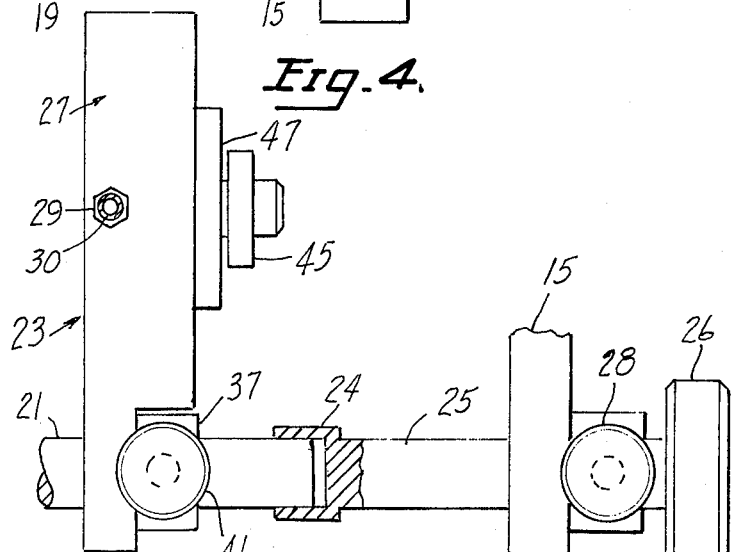
FIG.4 is an end view of the applicator of FIG. 3 showing the mounting means.

As best seen in FIGS. 3, 4 the housing of each gear pump is generally designated 27 and is provided with an inlet 29 through which glue is supplied from a reservoir 28, indicated schematically in FIG. 1, and a flexible tube 30 to the gears 31, 32 (FIG. 3) which discharge the glue under pressure to a discharge nozzle 33. The structure of the pump per se is conventional and no claim is made to the gear pump itself except in combination with the web feeding structure disclosed and except for its mounting means, drive means and positioning means which will now be described.

The housing 27 is formed with an extension portion 35 provided with a boss 37 and a through aperture 39 adapted to receive therethrough the rod 21. By this structure the housing of the gear pump is slidably and swingably supported on rod 21 which acts as a pivot, and a knurled headed screw 41 in boss 37 serves to secure the housing 27 in any desired position lengthwise of rod 21 or at any position in a plane at right angles to rod 21.

At this point it will be noted that the above described structure permits one or more pump housings to be mounted at any desired point along the length of rod 21 and also permits each housing to be swung on rod 21, acting as a pivot, toward and away from web 17.

To permit nozzle 33 to be accurately positioned a few thousandths of an inch away from web 17, which is desirable to permit proper glue application, a roller 45 is rotatably mounted relative to housing 27 and which roller is adapted to engage web 17 as it moves around feed roll 12. In this manner the discharge nozzle 33 may be positioned the slight distance from web 17 which is required. To assist in providing this necessary accurate adjustment, roller 45 is preferably rotatably supported on a plate 47 which in turn is fixedly but adjustably secured to housing 27 by screws 49. By providing ample clearance between screws 49 and the corresponding holes in plate 47, the latter, and therefor roller 45, may be shifted as desired to provide the proper close clearance between discharge nozzle 33 and the web 17.

The drive for the gear pumps will now be described.

Since it is desirable to be able to adjust the speed of the gears in the gear pump in order to adjust the rate of discharge of the glue a variable speed source of power is preferred. For example, as indicated in FIG. 1, a variable speed unit generally designated 51 such as one sold under the trademark "Zeromax", or equivalent, may be employed. Such a unit may have its own source of power or may conveniently be driven from the collator power train which can include, for example, a pulley 53.

The output sprocket 55 of variable speed unit 51 is connected by chain 57 to a sprocket 59 fixed on a shaft 61 which in turn is rotatably supported in rear plate 11. Also fixed on shaft 61 is another sprocket 63 which drives a chain 65 which in turn drives sprockets 64, 65, 66 as indicated in FIGS. 1, 2.

Gear 32 of the gear pump is provided with a hexagonal, or other noncircular hole which is adapted to receive therethrough a hexagonal shaft 69 which in turn is received within a similar hexagonal hole formed centrally of sprocket 65. By this structure it will be apparent that each gear pump mounted on rod 21 may be driven through its gear 32 from sprocket 65 and the amount of discharge of the glue may be adjusted through variable speed drive 51.

On the opposite side of feed roller 12 from shaft 21 is a similar shaft 21′ which is also supported between rear plate 11 and the flat bar 19 supported on front plate 15. Similarly another hexagonal shaft 69′ is releasably secured to sprocket 59 so that the gear pump housings on shaft 21 may be removed therefrom and reversed in direction and mounted on rod 21′ to be driven by hexagonal rod 69′.

As disclosed in U.S. Pat. No. 3,794,232 it is desirable to be able to reverse the direction of travel of a web to permit optimum use and efficiency of the collator. To this end the above described structure allows the web 17 to be reeved around the right hand side of feed roller 12 when it is desired to reverse the direction of movement of the collated webs.

Figure 5:
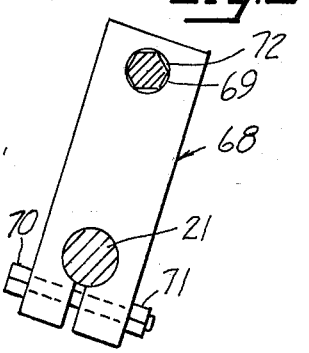
FIG. 5 is a cross section taken in a plane indicated by lines 5—5 of FIG. 2.

As best seen in FIG. 5 hexagonal shaft 69 is supported from rod 21 by means of a clamp generally designated 68 which is removably secured to rod 21 at its lower end by means of bolt 70 and nut 71 and which is provided with a hole 72 at its upper end in which the shaft 69 is rotatably supported. The outer end of shaft 69 is provided with a handle 74 (FIG. 2) by which the hexagonal shaft 69 may be pulled out of the sprocket 65 to stop the pumps. To facilitate the starting and stopping of the gear pumps 23 a projecting pin 75 (FIG. 2) is provided on shaft 69 and which pin is adapted to abut clamp 68 when the rod 69 is pulled away from the sprocket 69 a sufficient distance to disengage it.

To facilitate the transfer of the gear pumps from shaft 21 to shaft 21′ and vice versa rod 21 is split adjacent its outer end and received in a socket 24 formed on an outer continuation 25 of rod 21. This part 25 is provided with a handle 26 by which part 25 may be pulled outwardly to release the outer end of rod 21 and to permit the gear pumps 23 to be slid off rod 21. A set screw 28 on flat bar 19 serves to secure part 25 against movement when the parts are assembled.

By the above described structure it will be seen that not only is waste of glue completely obviated, but the position of the gear pumps is readily adjusted and the driving power readily connected and disconnected. When the power for running the gear pumps is taken from the collator as above suggested the speed of the gear pumps and the amount of discharge is directly proportional to the speed of the web which is desirable.

I claim:

1. In combination with a moving web of paper or the like, a glue applicator for applying glue to said moving web comprising:

a glue pump including a housing therefor, said housing being formed with an inlet for glue and a discharge nozzle, means mounting said housing in close proximity to said web with said discharge nozzle positioned for applying the discharged glue directly from said nozzle to said moving web, a rotating member associated with said moving web and rotating at a speed proportional to the speed of said web, a rotatable rod of noncircular cross section for driving said pump, said pump including a driven gear formed with a through opening having a cross section complementary to the cross section of said rotatable rod and receiving the latter therethrough, means interconnecting said rotating member and said rod for driving said pump at a speed proportional to the speed of said moving web.

2. The combination of claim 1 wherein said pump is adjustable to different positions along the length of said rod.

3. The combination of claim 1 wherein said rod is readily removable from said pump to stop the latter and prevent discharge of glue therefrom.

4. The combination of claim 1 wherein a second pump is mounted in a manner similar to said first mentioned pump and connected to said rod.

5. The combination of claim 4 wherein said pumps are relatively movable along the length of said rod.

6. The combination of claim 1 wherein said moving web is reeved about a rotating roller and said mounting means supports said housing for discharging the glue in one direction, and second mounting means for supporting said housing for discharging the glue in substantially the opposite direction when the direction of movement of said web is reversed.

* * * * *